US005951377A

United States Patent [19]

Vaughn et al.

[11] Patent Number: 5,951,377

[45] Date of Patent: Sep. 14, 1999

[54] MICROFINISHING MACHINE

[75] Inventors: Richard P. Vaughn, Kirtland; Antonio Pilla, Chesterland; Donald A. Gorg, Mentor, all of Ohio

[73] Assignee: Radtec, Inc., Kirtland, Ohio

[21] Appl. No.: 08/893,394

[22] Filed: Jul. 15, 1997

Related U.S. Application Data

[60] Provisional application No. 60/022,928, Aug. 1, 1996.

[51] Int. Cl.[6] ..... B24B 1/00

[52] U.S. Cl. ..... 451/49; 451/14; 451/17; 451/307; 451/5; 451/311; 451/303

[58] Field of Search ..... 451/307, 5, 311, 451/49, 14, 17, 303, 296, 355, 489

[56] References Cited

U.S. PATENT DOCUMENTS

| | | | |
|---|---|---|---|
| 2,910,809 | 11/1959 | Heesemann | 451/303 |
| 4,292,767 | 10/1981 | Fatula . | |
| 4,796,387 | 1/1989 | Johnson . | |
| 4,833,834 | 5/1989 | Patterson et al. . | |
| 4,945,683 | 8/1990 | Phillips . | |
| 4,993,191 | 2/1991 | Judge et al. . | |
| 5,058,325 | 10/1991 | Pineau . | |
| 5,060,423 | 10/1991 | Klotz . | |
| 5,142,827 | 9/1992 | Phillips . | |
| 5,224,300 | 7/1993 | Pineau . | |
| 5,251,404 | 10/1993 | Wasserbaech . | |
| 5,359,813 | 11/1994 | Kaiser, Jr. et al. . | |
| 5,367,866 | 11/1994 | Phillips . | |
| 5,371,973 | 12/1994 | Kaiser, Jr. . | |
| 5,437,125 | 8/1995 | Barton, II . | |
| 5,507,684 | 4/1996 | Schwar . | |
| 5,531,631 | 7/1996 | Judge . | |
| 5,536,201 | 7/1996 | Winkelmann . | |
| 5,628,678 | 5/1997 | Tridico | 451/355 |
| 5,722,878 | 3/1998 | Phillips | 451/49 |

OTHER PUBLICATIONS

P. 107 of Jun. 1998 edition of Hot Rod Bikes, News Release concerning K–Line Micro–Polisher.

LANDIS Multi–Heat Cam Lobe Grinder (1 double sided page) Copyright 1993 Landis Grinding Machines.

Masco Machine Incorporated booklet entitled "Product Review" cover page and 15 pages.

LANDIS Multi–Head Cam Lobe Grinder booklet (Revised Jan. 18, 1995).

*Primary Examiner*—Robert A. Rose
*Assistant Examiner*—G. Nguyen
*Attorney, Agent, or Firm*—Fay, Sharpe, Beall, Fagan, Minnich & McKee

[57] ABSTRACT

A sizing and finishing machine includes a mechanism for rotating an associated workpiece and a first microfinishing belt for selectively contacting the associated workpiece. The belt has a maximum grit size of 60 microns. A structure is provided for rotatably holding the first microfinishing belt and a housing is provided on which the structure is mounted. A mechanism moves the first housing and hence the first microfinishing belt toward and away from the associated workpiece. The mechanism is timed to the rotation of the associated workpiece to maintain a substantially constant pressure of the first microfinishing belt on the associated workpiece. If desired, a second microfinishing belt mounted separately on a second housing can be provided with the two housings and their respective belts being separately controlled. The force exerted by the microfinishing belt on the associated workpiece is limited to a pressure of less than approximately 25 psi.

34 Claims, 14 Drawing Sheets

MICROFINISHING MACHINE

BACKGROUND OF THE INVENTION

This application bases its priority on United States Provisional application Serial No. 60/022,928 which was filed on Aug. 1, 1996.

The present invention relates to a method and an apparatus for sizing and finishing, microfinishing or surface polishing of workpieces. More specifically, the present invention relates to a method and apparatus for sizing and finishing components used in engines, transmissions, compressors and the like.

Surface polishing or "microfinishing" is a process wherein an abrasive belt is brought to bear against a workpiece which has been previously rough ground or turned. Microfinishing is a lower force abrading process which generally follows rough grinding. Since microfinishing incorporates lower cutting forces than does grinding, the heat and pressure variances are minimized to provide improved size and geometry control. Surface quality or roughness is generally measured in roughness average values ($R_a$) wherein $R_a$ is the average deviation of minute surface irregularities from hypothetical perfect surfaces. Microfinishing can provide surface quality of approximately one to ten micro-inches (0.025 to 0.25 micro-meters).

It is known that engine crankshafts and cam shafts, transmission components, bearings, rotary compressor parts and the like require highly accurate size, roundness and finishes of such accuracy on various surfaces in order to function correctly. Some of the aspects of such components which need to be highly accurate include cylindrical diameters, cone type diameters, camlobes, flat surfaces, thrust surfaces and the like. Currently, such components are either ground or turned to specific tolerances leaving additional stock for sizing and finishing.

It is known to use abrasive belts, in roll form, for sizing and finishing. Known apparatus of this type indexes a section of the abrasive belt for each cycle of finishing. The known apparatus uses either 1, 2 or 3 shoes—which are manufactured to a specific mean size of the component's contour—to support the abrasive belt. Other backup support designs are also known. While these backup supports are manufactured to a specific contour, they incorporate mean tolerance factors into the design. Both the shoes and the backup supports are used to hold the abrasive surface in position on the workpiece surface which is meant to be finished during the finishing process.

However, mean tolerances of the shoes or backup supports are not precise enough to match the exact geometry of incoming components, which have variable sizes and shapes. In addition, the known sizing and finishing process generates heat which distorts the product being sized, i.e. such as a bearing, due to the semi or full wrap-around nature of the backup support or shoe which holds the abrasive belt. Wrap-around backup supports seal out coolant for the workpiece surface and do not allow the abrasive to cleanse itself. This causes material and abrasive build-up consequently generating heat and distortion of the workpiece which is being finished. If the workpiece is a bearing, the existing process has the abrasive fixed around the bearing surface. During part rotation, this changes the surface speed, in feet per minute, of the abrasive on the bearing surface, which can cause out-of-round conditions on eccentric bearing diameters and a distortion of camlobes.

The known apparatus requires that eccentric bearings, e.g. crankpin bearings on a crankshaft, push and pull the tooling mass which holds the abrasive against the bearing surface during workpiece rotation. This causes bearing out-of-round and lobbing. The known apparatus also requires the tooling to remain on all of the crankpin bearing diameters of a crankshaft in a relaxed state (when multiple bearing and sizing is required) while remaining tooling is completing its sizing process. This also causes bearing out-of-round and lobbing. Moreover, the known apparatus incorporates several mechanisms in a design which is relatively complicated resulting in lower reliability and higher maintenance costs. Finally, running the known apparatus consumes a large amount of energy.

Industry requires manufacturing tools which are capable of producing more stringent tolerances for workpiece size and finish. There is thus a need for more precise sizing and finishing equipment.

Accordingly, it has been considered desirable to develop a new and improved method of and an apparatus for sizing and finishing workpieces which would overcome the foregoing difficulties and others and meet the above stated needs while providing better and more advantageous overall results.

BRIEF SUMMARY OF THE INVENTION

The present invention relates to a method and apparatus which provides a line contact between a moving abrasive belt and a workpiece which is to be sized and finished. The diameter of the workpiece will vary the width of the line contact dimension. It also allows air or coolant to flow with the workpiece and abrasive belt rotation thereby allowing the abrasive belt to be cleansed. This eliminates material and abrasive build-up, consequently eliminating heat-caused workpiece distortion. The apparatus is electronically controlled and allows a variable abrasive belt speed on eccentric products, such as crankshaft pin bearing diameters, to insure constant surface feet per minute of abrasive on the workpiece surface being sized and finished. The tooling housing does not incorporate a backup support which allows the abrasive belt to conform to the incoming workpiece thereby maintaining or improving the workpiece geometry.

The abrasive belt is mounted on a linear bearing tooling slide which can be controlled by either air or hydraulic cylinders, a linear motor, a servo driven ball screw or a linear toothed belt. The tooling slide maintains abrasive belt contact with the workpiece surface during workpiece rotation. The use of fractional and small horsepower motors in the apparatus disclosed herein lessens energy consumption in relation to the current sizing and finishing machines.

One advantage of the present invention is the provision of a new and improved microfinishing system which employs substantially a line contact between a moving abrasive belt having a fine grit size (preferably less than 60 microns) and a rotating part being finished, even when the part has an eccentric shape. Preferably, the workpiece is rotated at a relatively low number of revolutions per minute and the force applied by the belt to the workpiece is limited so as to be less than approximately 25 lbs./sq. inch.

Another advantage of the present invention is the provision of a microfinishing apparatus which allows air or another type of fluid coolant to flow with part and abrasive belt movement. This allows the abrasive belt to be cleansed, eliminating material and abrasive build-up and consequently eliminating heat and distortion of the part which is being microfinished, as well as a reduction in consumable tooling costs. Preferably, a "dry" system is provided in which only air is used for the cleansing operation since any liquid would have a tendency to seep between the abrasive belt and the rollers on which it rides, causing the belt to slip off the rollers, if they are crowned rollers.

Still another advantage of the present invention is the provision of a microfinishing apparatus which permits a variation in the speed of movement of an abrasive belt that is employed. Preferably, the belt is an endless abrasive belt which can be driven in the same rotational direction as the workpiece is being rotated, or in the opposite direction.

Yet another advantage of the present invention is the provision of a microfinishing apparatus which is mounted on a linear bearing tooling slide to allow for a computer controlled, rapid, and relatively friction-free, movement of an abrasive belt mechanism of the apparatus with, or without workpiece oscillation, as may be desired.

A further advantage of the present invention is the provision of a microfinishing apparatus and process which is computer controlled. This allows several finishing tooling elements, such as finishing heads, to retract independently, e.g. when multiple bearing sizing and finishing is required, upon achieving the desired size without waiting for the other finishing heads to achieve the desired size. This facilitates the microfinishing of several bearing diameters simultaneously.

A still further advantage of the present invention is the provision of a microfinishing machine which includes a first housing for rotating an associated workpiece and one or more second housings on each of which an endless abrasive belt is mounted. A belt rotation speed controller controls the rotational speed of each belt. A separate position and velocity controller controls a location and a velocity of movement of each of the second housings in relation to the workpiece.

A yet further advantage of the present invention is the provision of the method for microfinishing a workpiece mounted on a first housing for rotation around a longitudinal axis of the workpiece. One or more abrasive belts, each mounted on a separate second housing, is independently moved toward and away from the workpiece so as to maintain a substantially constant pressure of that abrasive belt on the workpiece as the workpiece rotates. Preferably, a line contact is maintained between each abrasive belt and the workpiece.

An additional advantage of the present invention is the provision of a microfinishing system which uses only about 50 per cent of the energy that is consumed by conventional microfinishing machinery.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
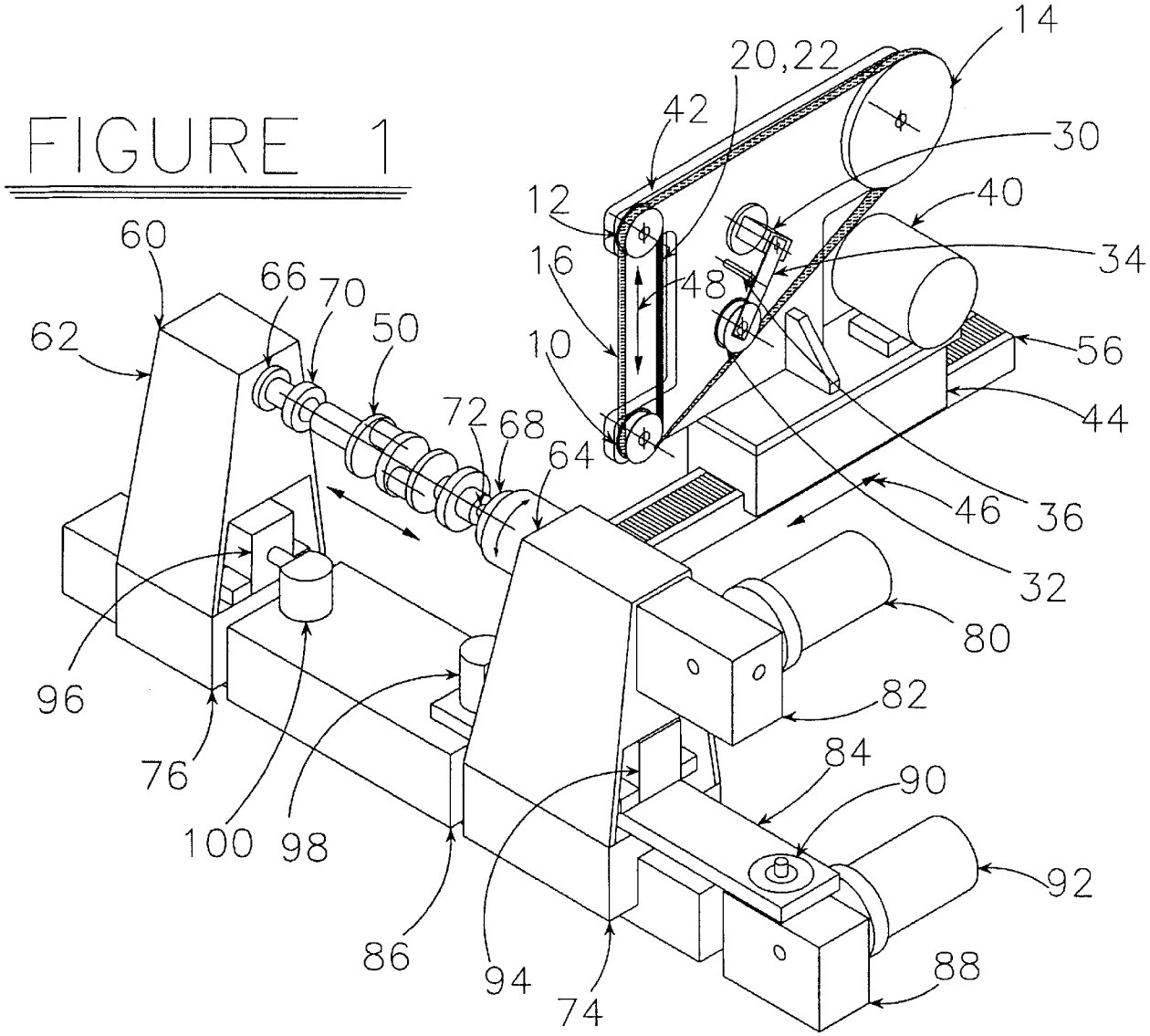
FIG. 1 is a perspective view of a workpiece sizing and finishing apparatus according to a first embodiment of the present invention.

Referring now to the drawings, wherein showings are for purposes of illustrating preferred embodiments of the invention only and not for purposes of limiting same, FIG. 1 shows a part sizing and finishing apparatus in which three accurately positioned rollers, namely two front rollers 10 and 12 and a main drive roller 14, track an abrasive belt, which is preferably an endless abrasive belt 16, during the full range of its motion. The abrasive belt mechanism is electronically controlled to provide a precise surface speed of the belt on the surface of the part or workpiece which is being sized and/or finished. While an endless abrasive belt 16 is illustrated herein, it should be appreciated that it would be just as possible to provide a cassette having two spools, namely, a first spool from which an abrasive belt or tape is played out and a second or take up spool spaced therefrom. In this type of arrangement, the abrasive tape would be played out from the first spool and taken up on the second spool with movement of the belt or tape only in one direction.

Based on the specification of the part or workpiece which is being sized and/or finished, a rotational backup 20 mounted on sheaves 22 can be used to back up the abrasive belt 16 during the full range of finishing. The rotational backup 20 can be a secondary belt made of, e.g., an elastic material such as rubber. Such a backup device may be useful when the sizing and finishing machine is employed to finish pin bearings or the like. It should be appreciated that other types of conventional resilient backup elements could also be provided behind the belt 16 such as, e.g., a resiliently biased shoe or a resiliently biased roller or the like. Alternatively, a roller or shoe made of a resilient material could be employed.

A belt release roller mechanism 30 employs a roller 32 and an arm 34. The roller 32 is retracted via a manually operated lever in order to allow the abrasive belt 16 to be changed. Of course, it should be recognized that the belt 16 could be released in a number of other conventional ways such as by an air cylinder (not illustrated) which moves the main drive roller 14. A proximity switch 36 is tripped when the belt release arm 34 is out of position thereby indicating that the abrasive belt 16 is not correctly positioned on the rollers.

The drive roller 14 can be driven by conventional sheaves and a belt (not illustrated) via a variable speed motor 40. It is desirable that a mounting plate 42 on which the belt mechanism is mounted, is made of a relatively lightweight material, such as aluminum, in order to reduce total tooling mass.

The mounting plate 42 is held on a tooling slide 44 to move the finishing tooling towards and away from a workpiece 50 in a relatively friction free manner and also to precisely track the rotational path of the workpiece. The workpiece can have eccentric bearings, camlobes or the like. From arrow 46, it can be appreciated that the tooling slide can reciprocate in relation to the workpiece 50. From arrow 48, it can be appreciated that the belt 16 can be moved either clockwise or counterclockwise on the mounting plate 42.

Figure 2:
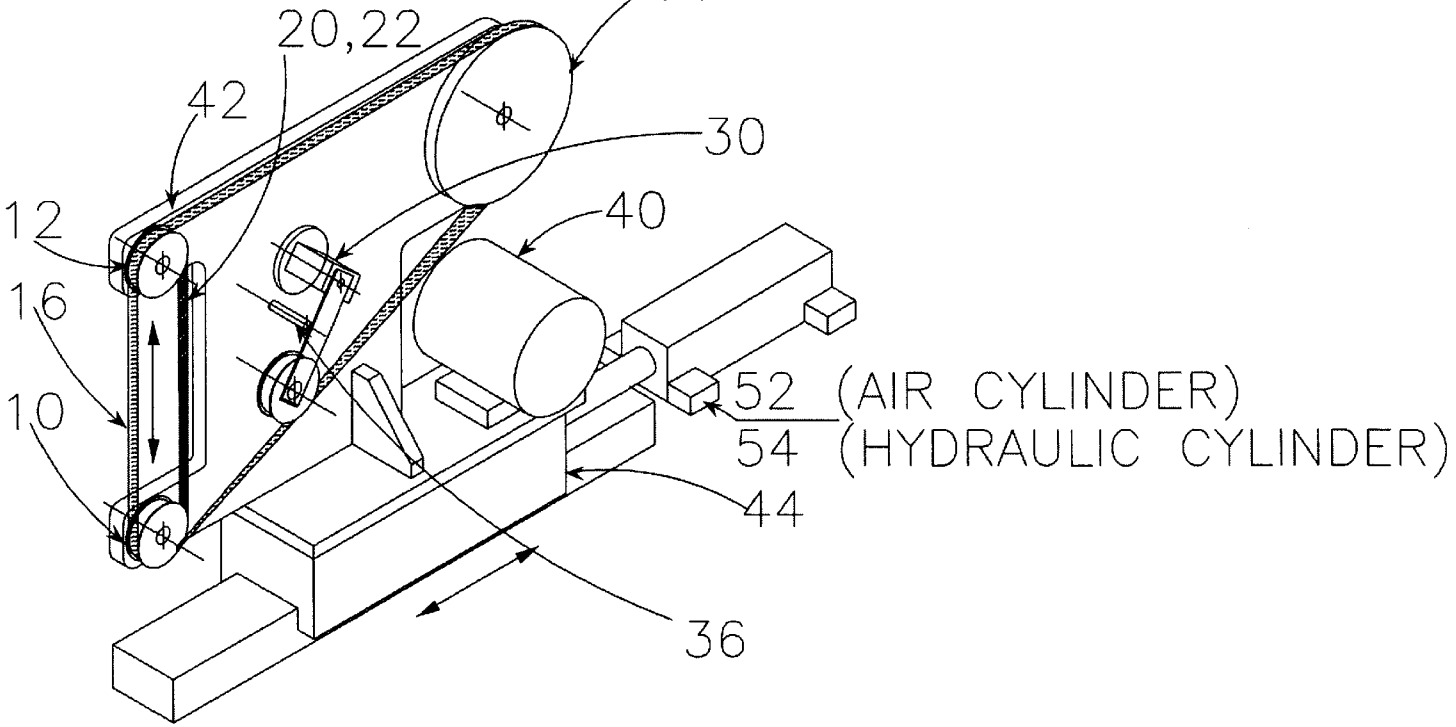
FIG. 2 is a perspective view of an abrasive belt housing and slide of the apparatus of FIG. 1 shown as being controlled by a cylinder-based system according to a second embodiment of the present invention.
Figure 3:
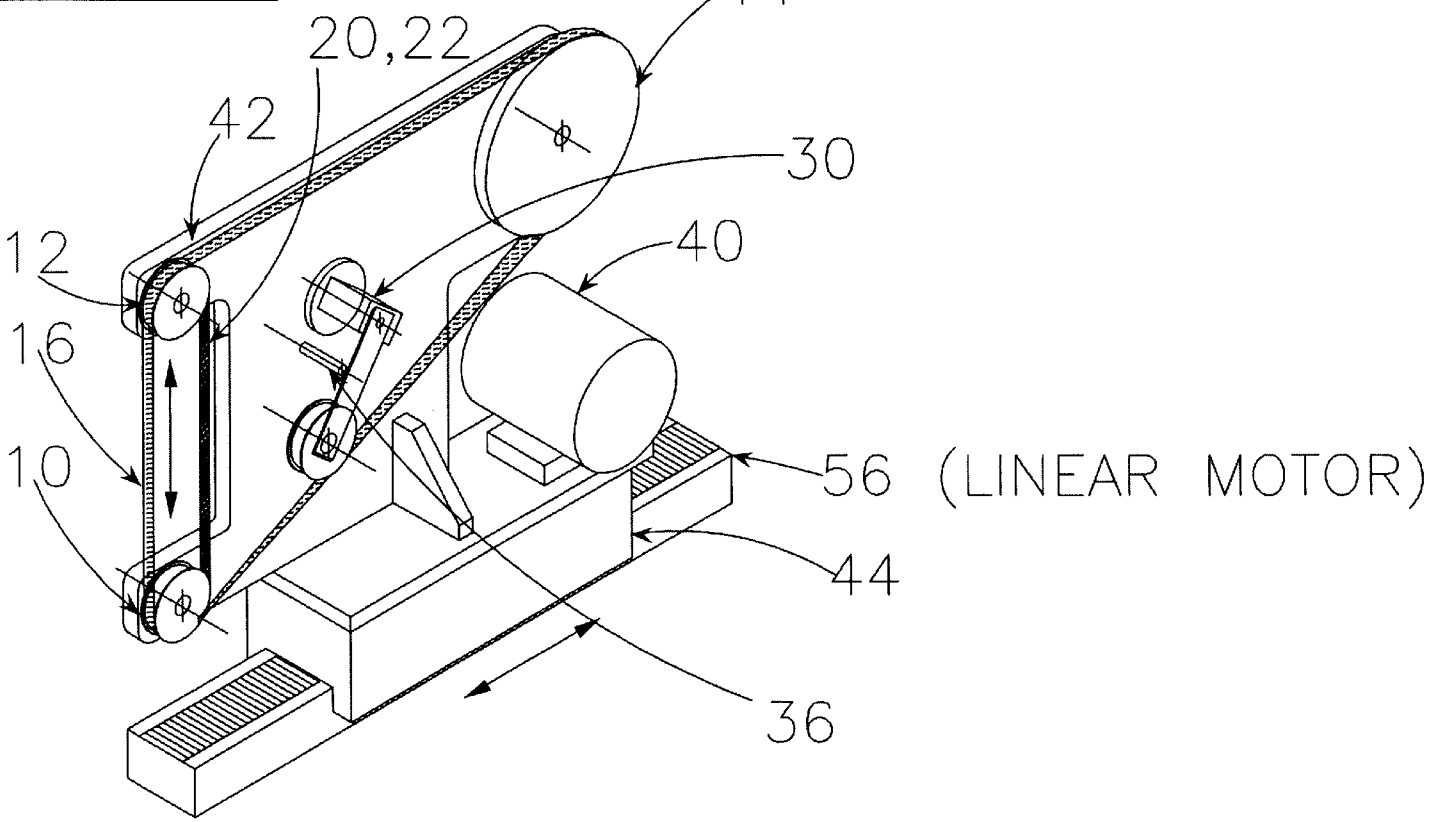
FIG. 3 is a perspective view of the abrasive belt housing and slide of FIG. 1 which is being controlled by a linear motor according to a third embodiment of the present invention.
Figure 4:
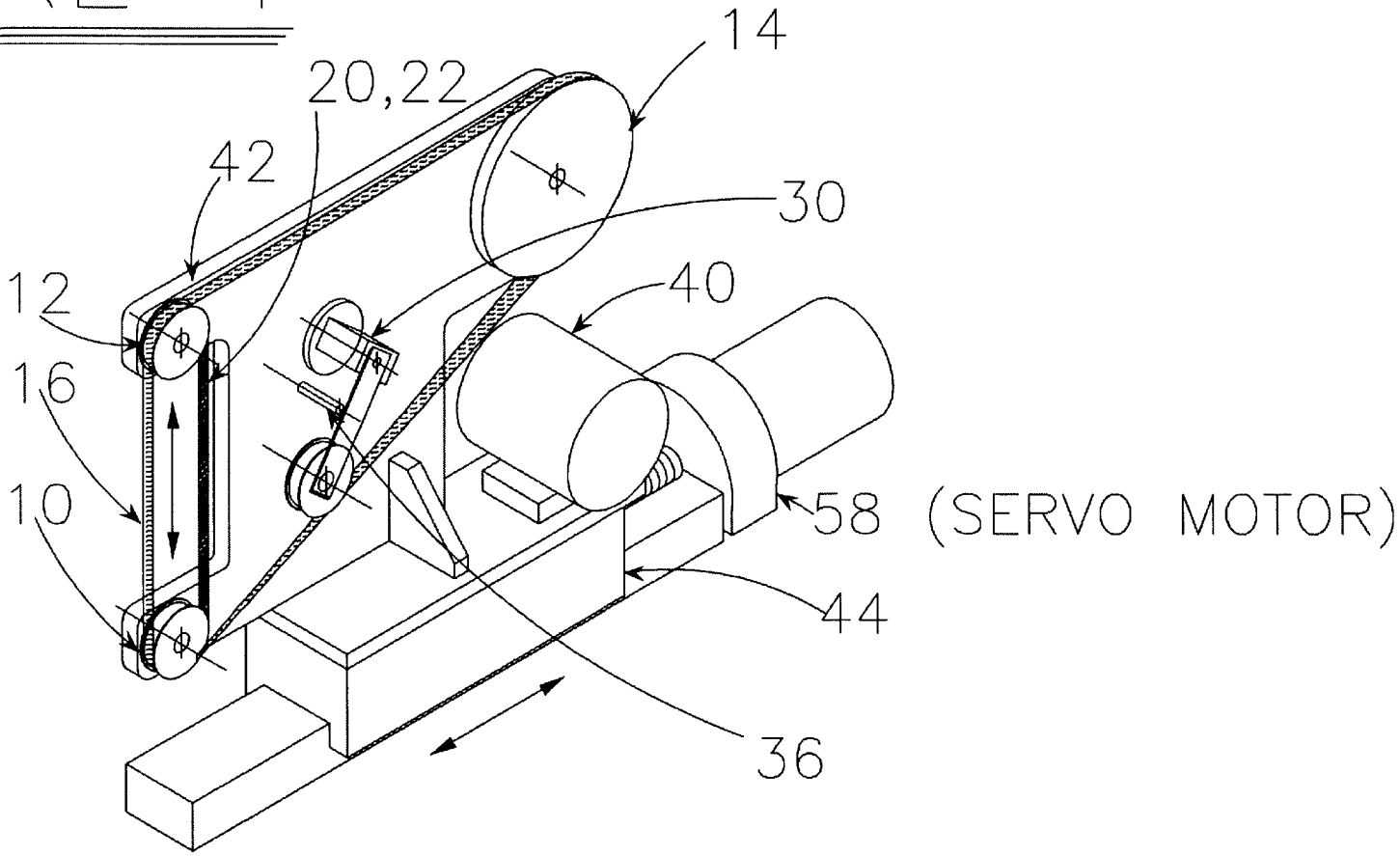
FIG. 4 is a perspective view of the abrasive belt housing and slide of FIG. 1 shown as being controlled by a servo driven ball screw or a servo driven toothed belt according to a fourth embodiment of the present invention.
Figure 5:
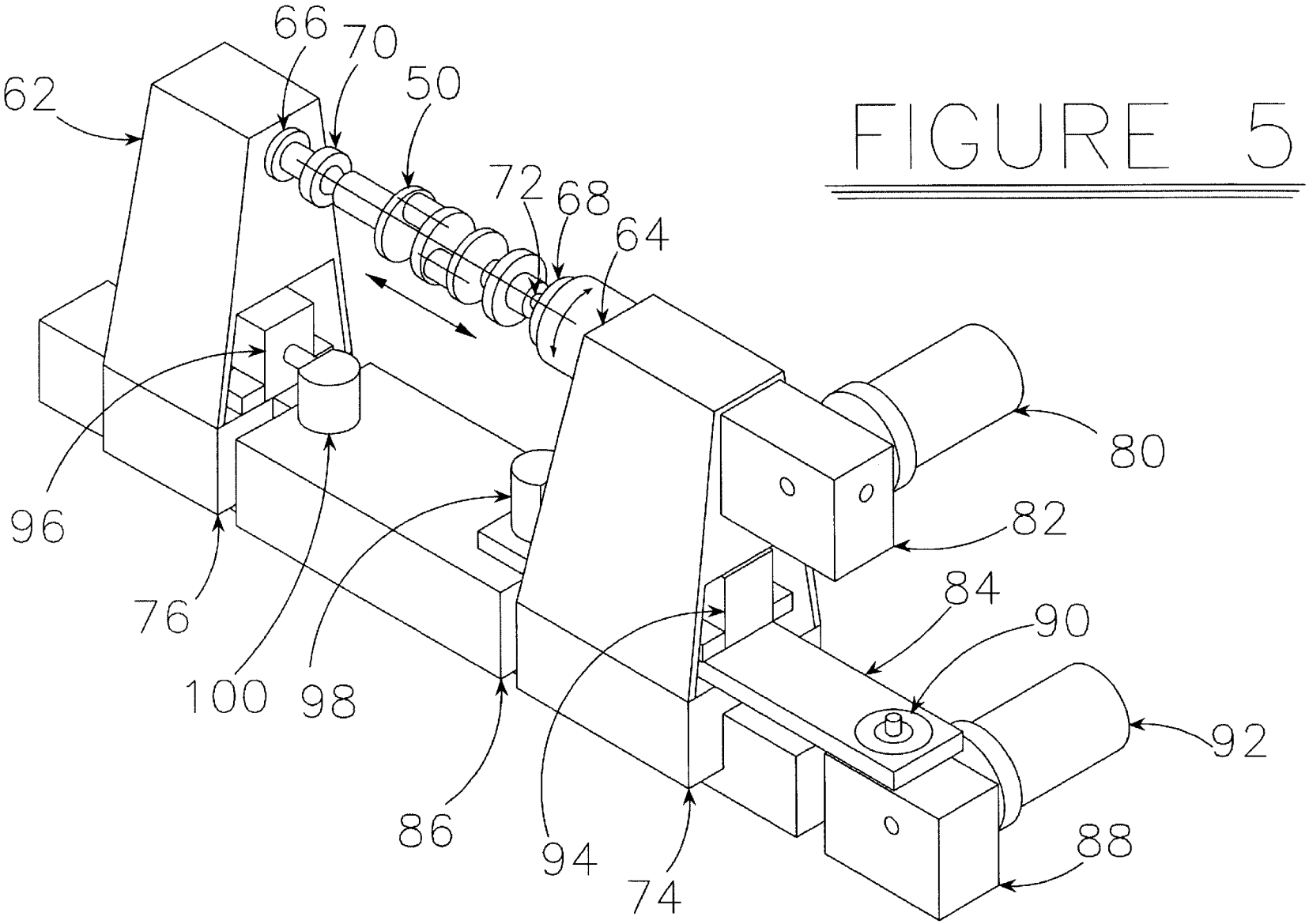
FIG. 5 is a perspective view of a headstock, tailstock, oscillating mechanism, and respective air bearing slides for these components, of the apparatus of FIG. 1 on an enlarged scale.

Movement of the finishing tooling can be performed in a number of ways depending on workpiece specifications and requirements. FIG. 2 illustrates the use of a conventional electrically controlled air balanced cylinder 52 or a conventional electrically controlled hydraulic balanced cylinder 54. FIG. 3 illustrates the use of a conventional linear motor 56 for moving the tooling slide. The linear motor 10 is also illustrated in FIG. 1. Finally, FIG. 4 illustrates a conventional ball screw or toothed belt (not illustrated) with a servo motor drive 58 for moving the tooling slide.

Figure 6:
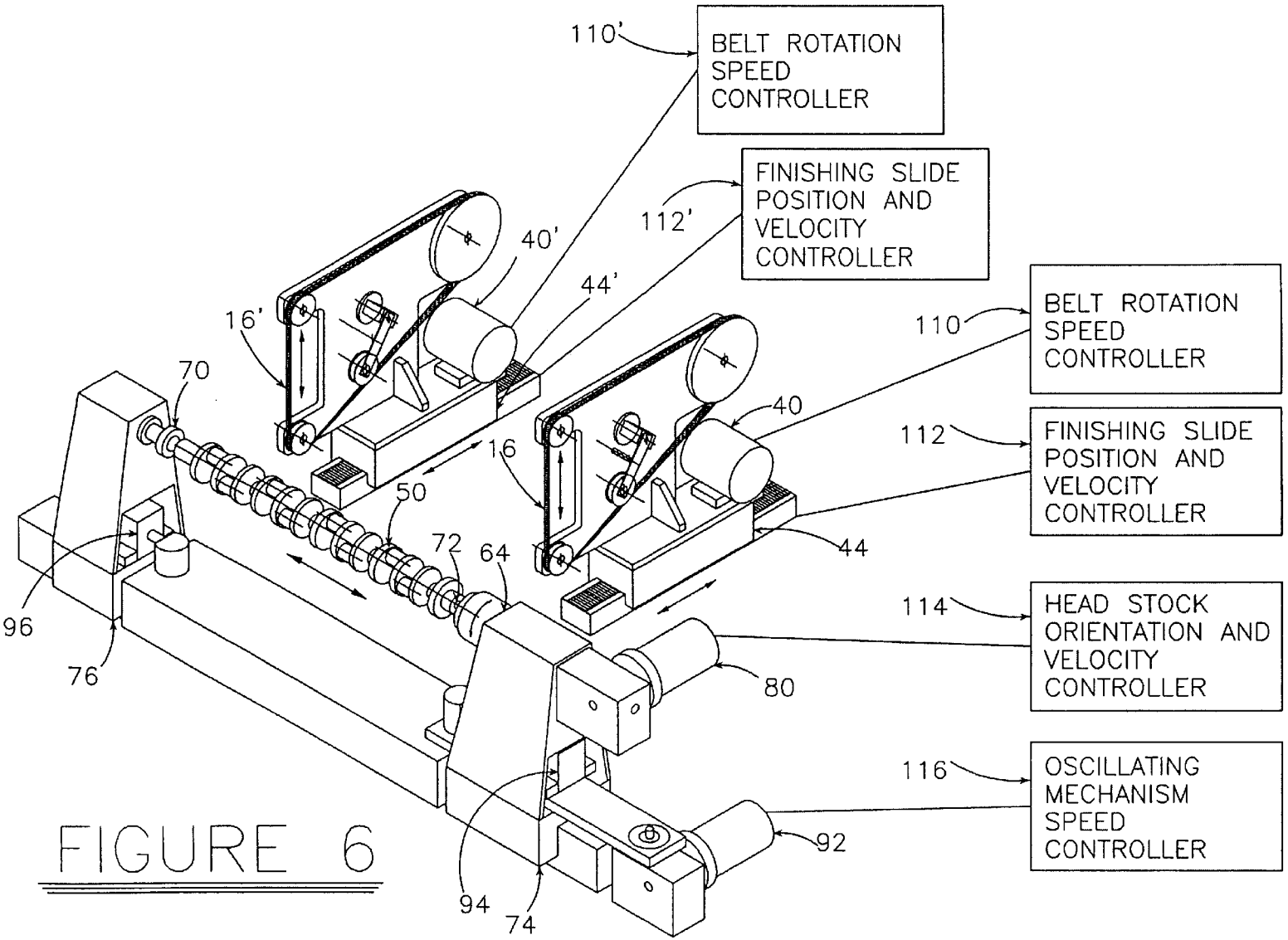
FIG. 6 is a perspective view of the finishing and sizing mechanism of FIG. 1, showing two housings on a reduced scale and including block diagrams illustrating, in schematic form, associated circuitry.

It should be appreciated that while FIG. 1 illustrates only a single abrasive belt 16, a plurality of such abrasive belts, arranged in a laterally spaced or ganged manner, can be driven by a suitable design of the rollers 10, 12 and 14 and/or by the addition of a second set of rollers that can be driven by the same motor 40. In addition, multiple finishing tooling can be used at a single station to accommodate parts which require sizing and finishing of multiple surfaces on a single workpiece. As illustrated in FIG. 6, preferably separate belts are driven by separate motors so that each belt can be independently advanced toward or retracted from the workpiece 50 and so that each belt can be rotated at the desired rate for that belt separately from the rotational speed of any adjacent belt and perhaps in a different rotational direction from the adjacent belt. Moreover, the belts can have different grit characteristics so as to microfinish the spaced surfaces of the workpiece to different extents.

With continued reference to FIG. 1, the workpiece 50 is held in a machine 60 including a headstock 62 and a tailstock 64. The headstock and tailstock can also be made of a suitable lightweight metal, such as aluminum, in order to reduce mass. The headstock and tailstock include spindles which incorporate a zero runout position design, as illustrated by the numerals 66 and 68, on the centers 70 and 72 of the workpiece 50 in order to insure that the workpiece rotates true on center without lobbing.

Preferably, the headstock 64 and tailstock 62 are mounted on linear bearing slides 74 and 76 to reduce friction when the workpiece 50 is oscillated during the sizing and finishing process. The headstock 64 can be driven by a variable speed motor 80 through a gear reduction mechanism 82 and incorporates spindle orientation for controlling precise stock removal on the surfaces of the workpiece 50.

The workpiece 50 can, if desired, be oscillated during the sizing and finishing process. Such oscillation may be useful to insure consistent surface quality, allow for better cutting action of the abrasive belt and to meet the specifications of the workpiece 50. The oscillating mechanism comprises a lever 84 with bored holes on each end. One end is attached to an oscillating bearing slide 86 and the other end is attached to a gear reducer 88 which incorporates an eccentric bearing 90 to produce the oscillation. The gear reducer 88 is driven by a variable speed motor 92. The headstock 64 and tailstock 62 are moved to and from the workpiece 50 by air or hydraulic cylinders 94 and 96 which are mounted on top of their respective slides 74 and 76 and are connected via posts 98 and 100 to the main oscillating linear bearing slide 86. Upon clamping the workpiece 50 between the headstock 64 and the tailstock 62, slides 74, 86 and 76 are connected as one unit with the headstock and the tailstock in order that the entire assembly will oscillate the workpiece 50 with precision controlled accuracy. Depending on the workpiece surface specifications, such oscillation may or may not be required. The mechanism disclosed by the instant invention allows for the oscillation to be electrically turned either on or off for the complete finishing cycle or turned on for part of the cycle and turned off for the remainder of the cycle.

With reference now to FIG. 6, a workpiece 50 is loaded onto loading rests (not illustrated) and is clamped by a command through pushbuttons on a control panel (also not illustrated). The cylinder 94 will move the headstock 64 and slide 74 forward to bring the headstock spindle 72 into contact with the workpiece 50. Forward motion of the headstock linear bearing slide 74 meets a positive stop and trips a limit switch signalling cylinder 96 to move the tailstock slide 76 forward in order to bring the tailstock center 70 into contact with the workpiece 50. This also trips a limit switch and completes the workpiece clamping process.

After the workpiece is clamped, a belt rotation speed controller 110 turns on the abrasive belt rotation a motor 40. A finishing slide position and velocity controller 112 moves the finishing slide 44 towards the workpiece 50. Upon advancement of the finishing slide 44, which is indicated by a position in the velocity controller 112, a headstock orientation and velocity controller 114 turns on the headstock spindle motor 80. Simultaneously, an oscillating mechanism speed controller 116 turns on the oscillation motor 92 which starts the bearing sizing and finishing cycle.

Preferably, more than one belt is provided, each mounted on its individual housing and driven by its individual motor so that several discrete sections of the workpiece 50 can be microfinished at the same time. To this end, a second belt 16' is driven by a second motor 40' with the housing of the second belt being reciprocated via a separate second finishing slide 44'. Belt rotation speed of the second belt 16' is controlled by a second belt rotation speed controller 110'. The position and velocity of the second finishing slide 44' is controlled by a second finishing slide position and velocity controller 112'.

After completion of the workpiece sizing and finishing cycle, which can be determined either by the number of workpiece rotations or by electronically controlled measuring equipment which measures the size and finish of the workpiece 50, the finishing slide 44 retracts from the workpiece as commanded by the finishing slide position and velocity controller 112. Then abrasive belt rotation is stopped by the belt rotation speed controller 110. The headstock spindle 72 is oriented to its starting position by the headstock orientation and velocity controller 114. Finally, the oscillation motor 92 is stopped by the oscillating mechanism speed controller 116. This completes one workpiece sizing and finishing cycle. After all relevant surfaces are sized or finished on the workpiece 50, the tailstock linear bearing slide 76 is retracted by the cylinder 96 and the headstock linear bearing slide 74 is retracted by cylinder 94 so that the workpiece 50 can be returned to its loading rests.

Figure 8A:
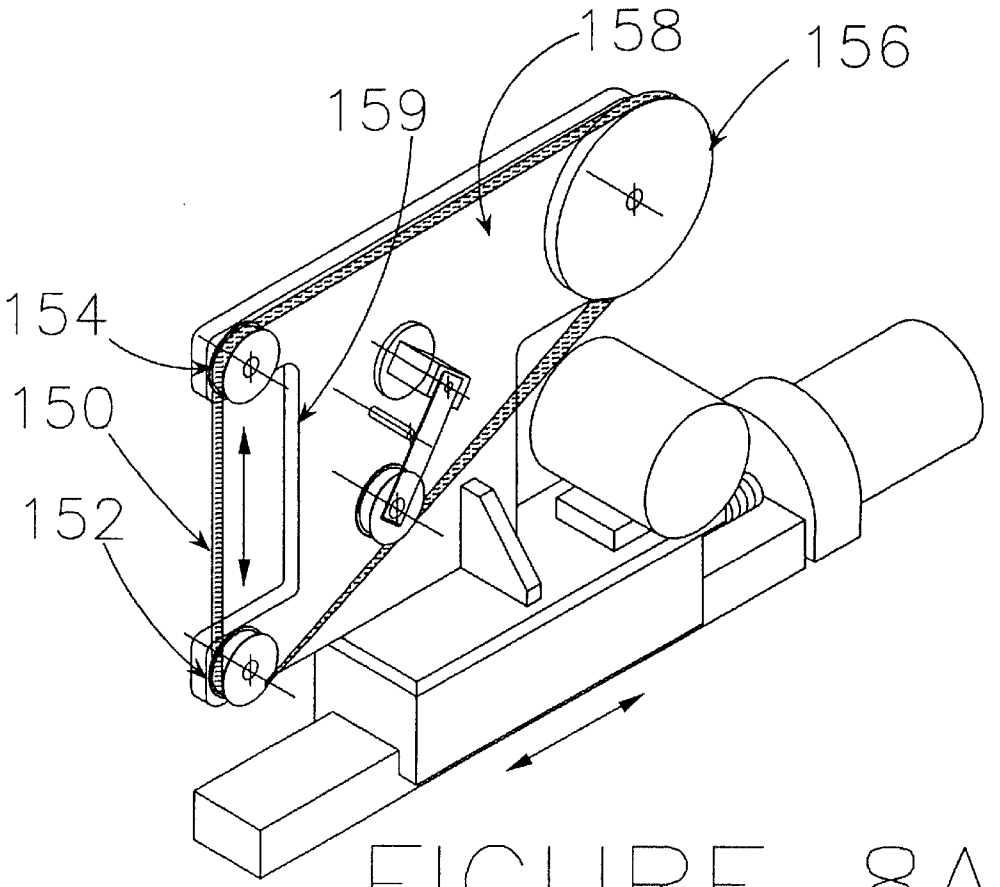
FIG. 8A is a perspective view of an abrasive belt housing and slide of a workpiece sizing and finishing apparatus according to a fifth embodiment of the present invention.
Figure 8B:
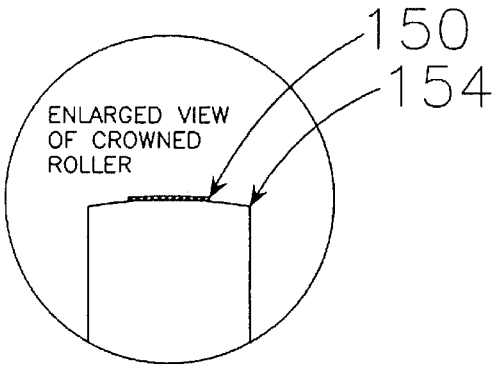
FIG. 8B is an enlarged front elevational view of a part of a crowned roller employed in the housing of FIG. 8A.

It should be appreciated that the abrasive belt 16 can have many different types of backing and/or grit configurations depending on the incoming workpiece size and finish with respect to the final surface specifications. For example, one could employ a thermoplastic or a cloth belt with, e.g., diamond, silicon carbide or other abrasive construction types of grit. A number of manufacturers sell abrasive belts which are suitable for use with the sizing and finishing apparatus disclosed herein. It should be appreciated that the abrasive belt width will need to change to suit the workpiece surface which is being finished. For example, the rollers 10 and 12 could be, e.g., 2 inches in width and the abrasive belt 16 could have a belt width of 2 inches or less. It would thus be possible to employ, for example, a half inch wide belt on 2 inch wide rollers. The belt would automatically center itself as it rotates as long as the roller is crowned, as is well known in the industry. A conventional crowned roller is illustrated in FIG. 8B.

The workpiece 50 can be rotated in the same direction as the abrasive belt or belts, or in the opposite direction depending on workpiece surface specifications. The workpiece revolutions per minute and abrasive surface footage speeds are independently variable to suit the part configuration and specifications. The rotational speed of the abrasive belt 16 can be anywhere from 50 to 6000 ft/per minute, or higher, if so desired. The amount removed from the workpiece 50 by the belt 16 depends on belt speed, the abrasive grit size and the pressure exerted on the workpiece by the belt for each revolution of the workpiece and, of course, on the number of revolutions of the workpiece. The abrasive grit size runs from a maximum grit size of about 60 microns to a minimum grit size of about 9 microns. The pressure which is being applied by the belt to the workpiece can be between about 5 to 25 lbs./sq. inch. The rotation of the workpiece 50 can be at a slow speed of about 2 to 20 rpm. All of these variables are controlled so as to limit the amount removed from the workpiece 16 and insure that a microfinishing process takes place on the workpiece rather than a grinding process. It may be adequate to rotate the workpiece only once in order to achieve a desired finish on the workpiece. However, for precise sizing, it will likely be necessary to have more than one revolution of the workpiece.

The preferred method of cleansing the abrasive and eliminating heat on the workpiece is simply air. Along with air, the process can incorporate a vacuum system to remove the finished material from the workpiece and also from the machine. Such an air vacuum system is an environmental plus over using a conventional coolant as is currently in use. Presently, the coolant and finished material do not separate, which could produce unacceptable environmental waste. Moreover, a liquid coolant is disadvantageous from the standpoint that the coolant has a tendency to coat the rollers on which the belt rides, thereby serving as a lubricant that allows the belt to slip off the rollers. However, if necessary, a fluid coolant other than air can be used to clean the swarf from the abrasive belt 16. It is necessary to eliminate the build up of abrasive either on the belt 16 or on the workpiece 50 in order to lengthen the life of the belt and to eliminate geometry distortion on the workpiece.

The present invention allows known electronically controlled measuring equipment (not illustrated) to determine when to withdraw the finishing tooling from the workpiece surface. Such measuring equipment is electronically interfaced with the controls of the finishing tooling slide 44 to insure precise withdrawal of the finishing tooling slide independently.

Preferably, the headstock spindle, oscillation and abrasive belt all incorporate known variable speed, low energy consumption motors. The workpiece being processed will determine the electrical program required to set all parameters and to insure highly accurate and repeatable sizes and finishes on the workpiece.

The present invention thus provides a sizing and finishing mechanism in which the variable speed abrasive belt can be rotated in the opposite direction from the workpiece, or perhaps in the same direction, with a line contact between the abrasive belt and the workpiece surface. Individually variable speed drives can be provided on the mechanism to either rotate or oscillate the workpiece, or both, in order to suit the specific sizing and finish requirements and/or specifications.

The present invention allows an integration of in-process gauging with an electrically controlled workpiece sizing and finishing slide in order to allow for precise withdrawal of the abrasive belt from the workpiece surface.

Figures 7A, 7B:
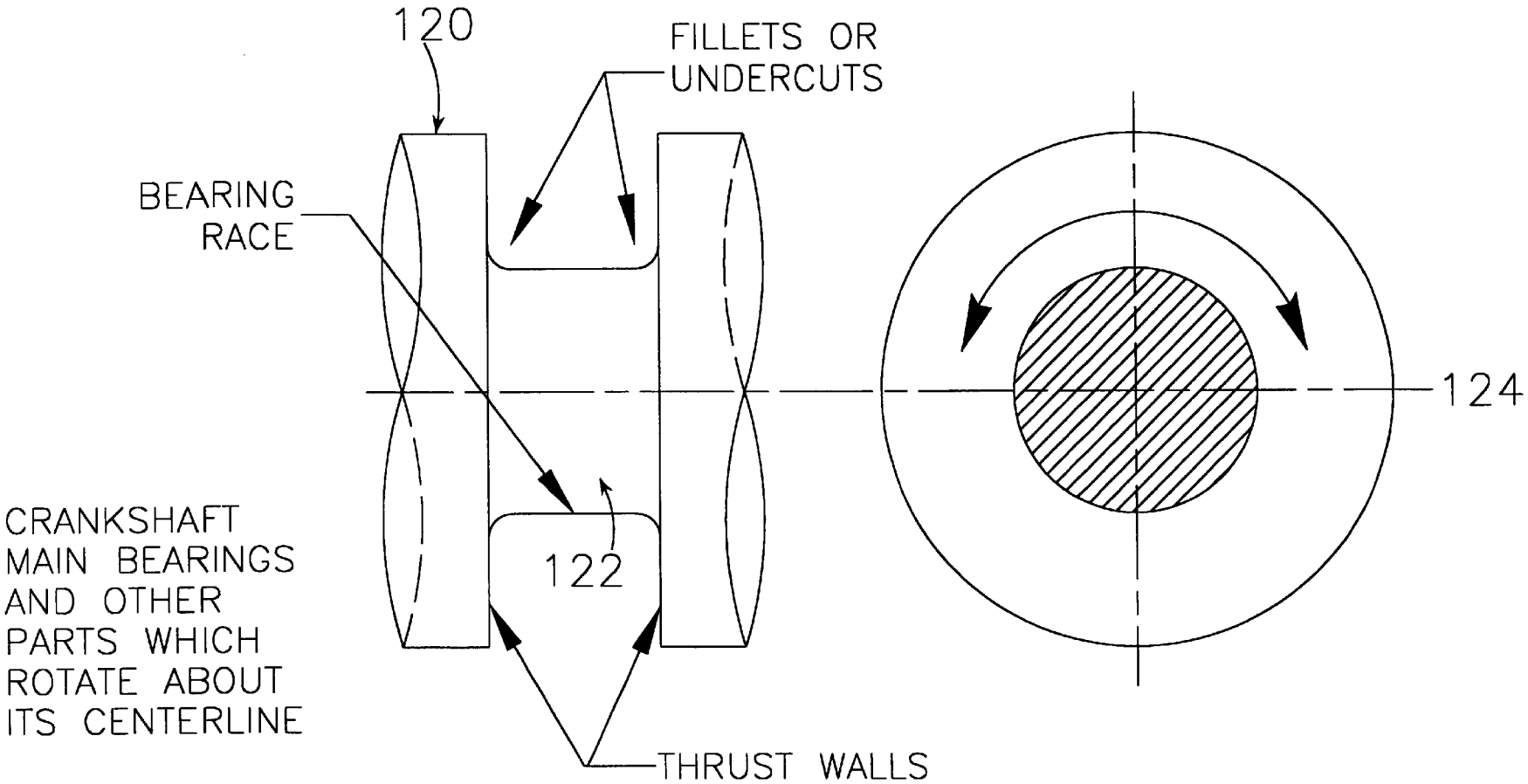
FIG. 7A is an enlarged front elevational view of a portion of a crankshaft main bearing which can be finished by the precision sizing and finishing machine according to the present invention.
FIG. 7B is an enlarged side elevational view in cross-section of the crankshaft main bearing of FIG. 7A.
Figures 7C, 7D:
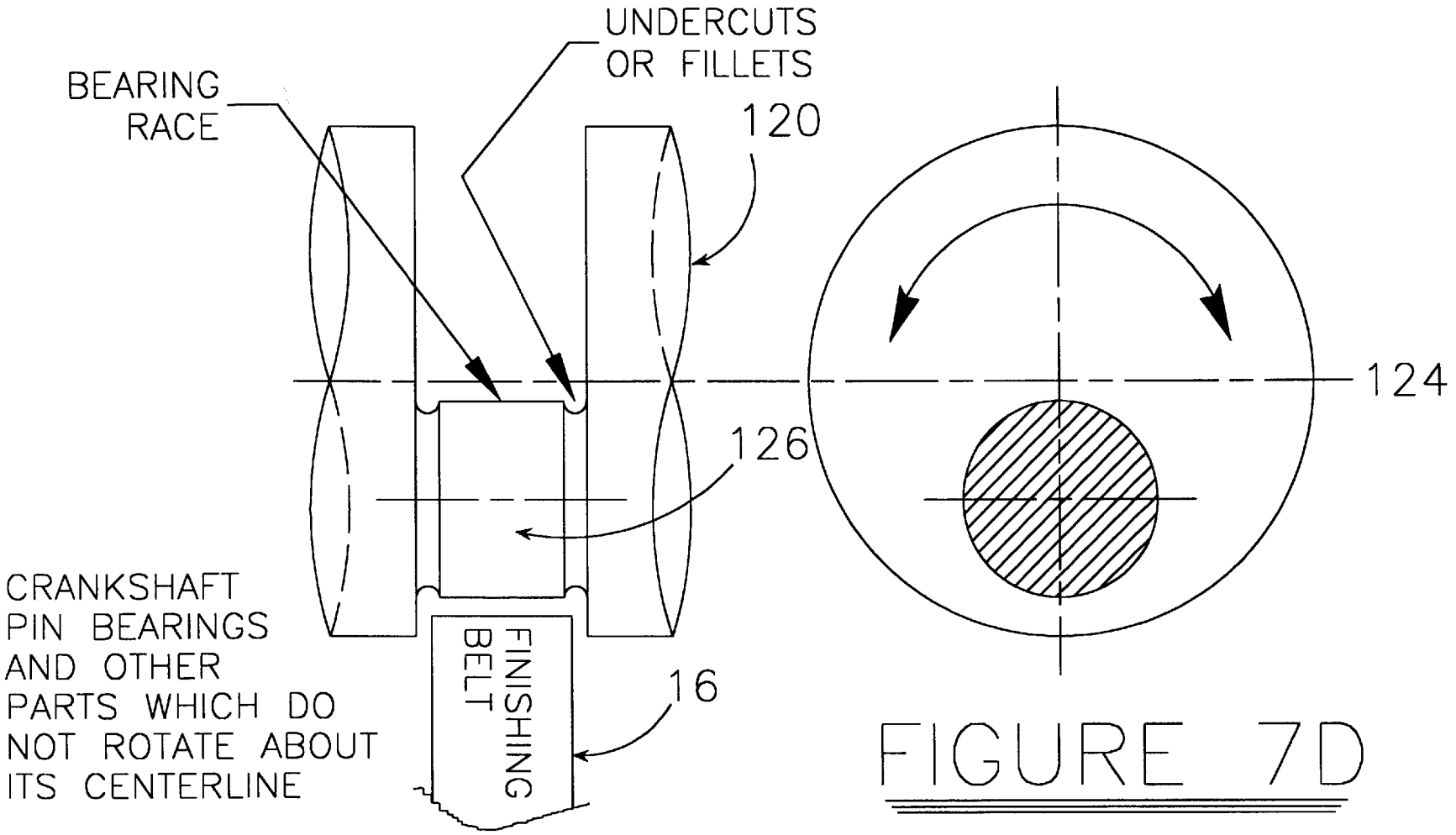
FIG. 7C is an enlarged front elevational view of a portion of a crankshaft pin bearing together with a schematic view of a finishing belt according to the present invention.
FIG. 7D is a side elevational view in cross-section of the crankshaft pin bearing of FIG. 7C.

FIG. 7A illustrates a portion of a crankshaft 120, more specifically, a main bearing 122 thereof. It is evident from FIG. 7B that the crankshaft main bearing 122 is located on an axial centerline 124 of the crankshaft 120. Located on the same crankshaft 120 is a pin bearing 126, as is illustrated in FIG. 7C. FIG. 7D shows that the crankshaft pin bearing is not located on the axial centerline 124 of the crankshaft. FIG. 7C also illustrates the finishing belt 16 as it is brought adjacent to the crankshaft pin bearing for sizing and finishing same.

Figure 7E:
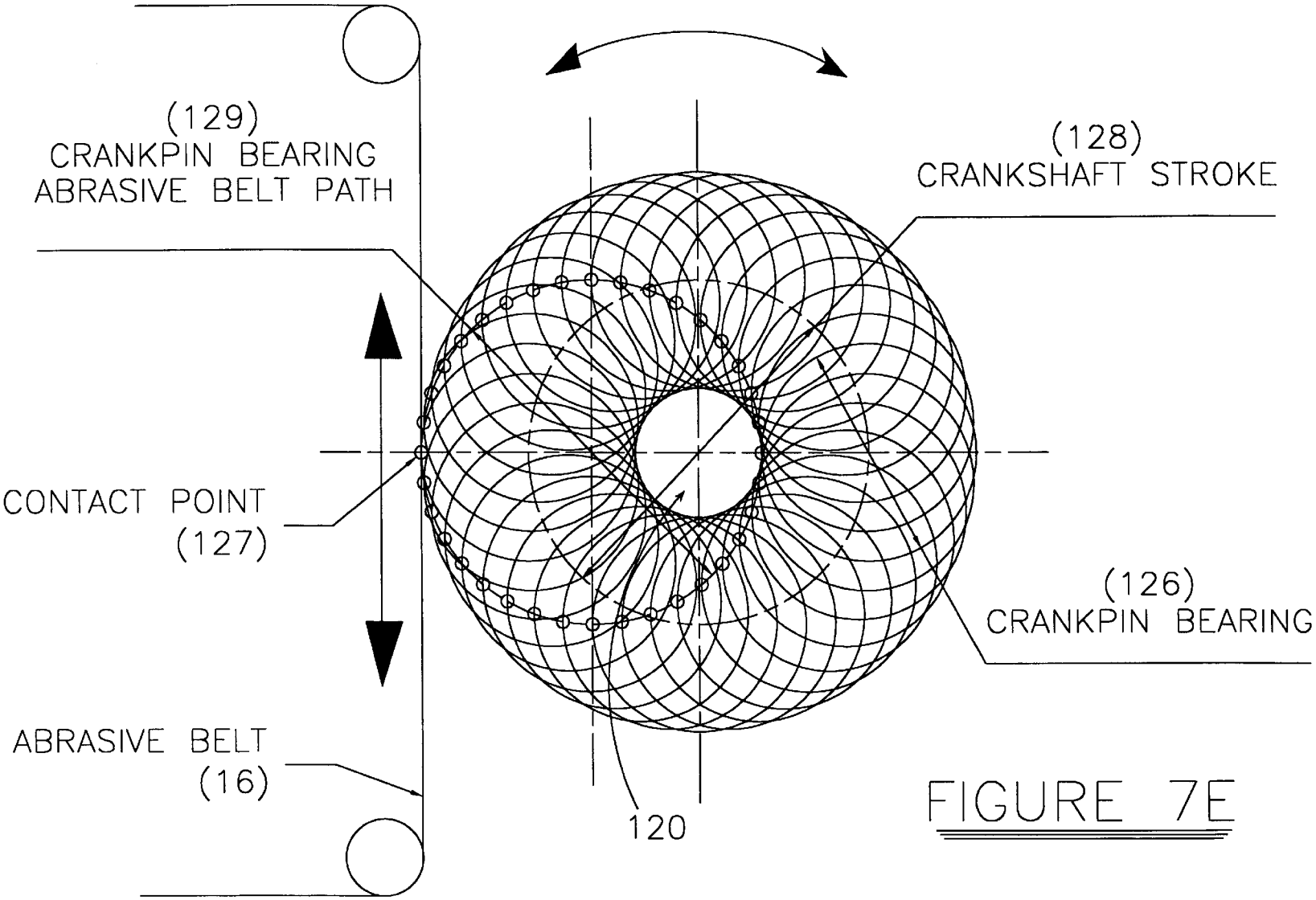
FIG. 7E is a schematic side elevational view of the contact points of the belt employed in the apparatus of FIG. 1 with a typical crankshaft pin bearing, such as in FIG. 7C, during the bearing's rotation as its crankshaft is being rotated.

FIG. 7E illustrates the rotation of a workpiece in relation to a particular area on the workpiece which is being worked. For example, if the workpiece is the crankshaft 120, and the crank pin bearing 126 thereof is being worked, then a contact point 127 between the abrasive belt 16 and the crankshaft 120 changes, as is illustrated in FIG. 7E dependent upon the precise rotational orientation of the crankpin bearing in relation to the crankshaft. To achieve this result, the tooling slide 44 needs to move forward and backward in relation to the crankshaft depending upon the rotational orientation of the crankshaft. Numeral 128 identifies the crankshaft stroke and number 129 identifies the abrasive belt path as the crankpin n bearing rotates.

Figures 7F, 7G:
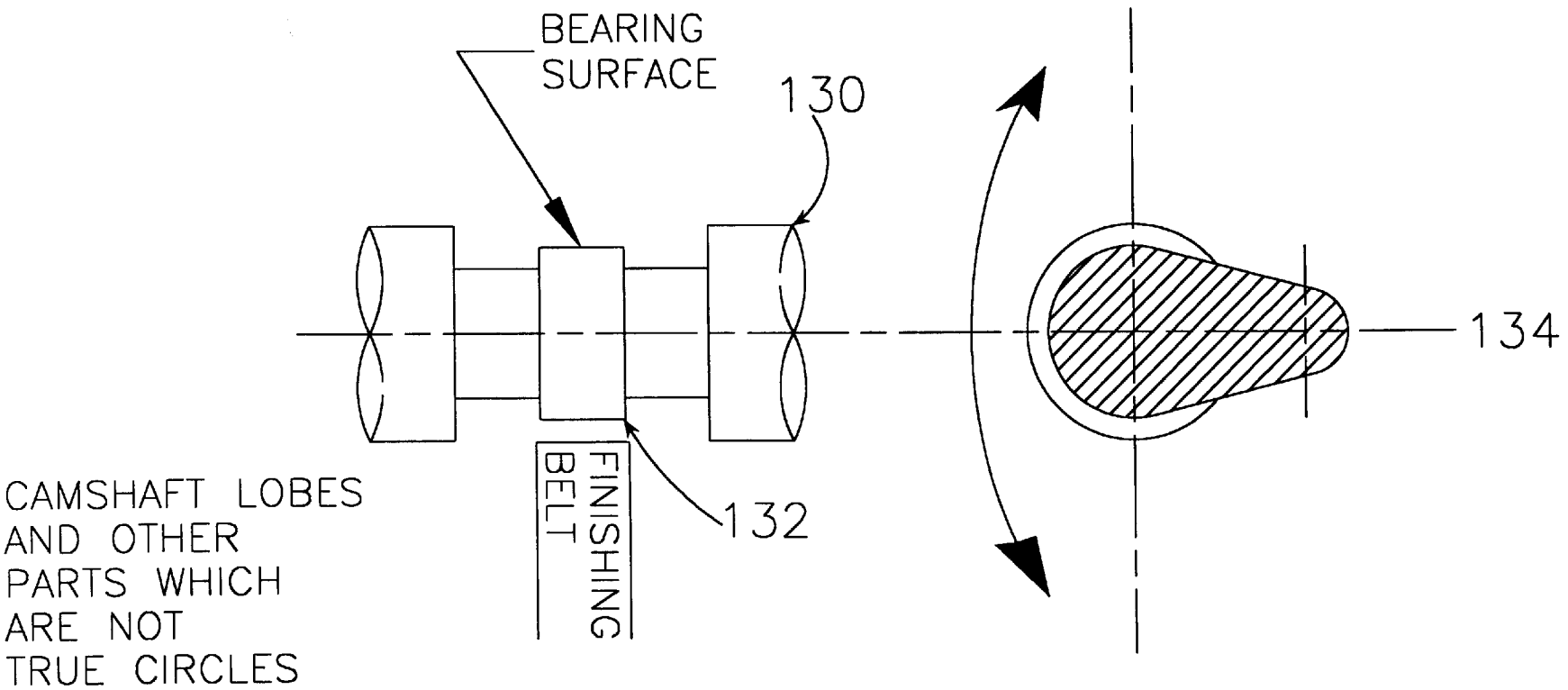
FIG. 7F is an enlarged front elevational view of a portion of a cam shaft lobe which can be finished by the precision sizing and finishing machine according to the present invention.
FIG. 7G is a side elevational view in cross-section of the cam shaft lobe of FIG. 7F.

FIG. 7F illustrates a cam shaft 130 with a cam shaft lobe or bearing surface 132. From FIG. 7G it can be seen that while the cam shaft lobe 132 is located along an axial centerline 134 of the cam shaft, the lobe is not a true circle. Therefore, the sizing and finishing machine needs to oscillate back and forth as illustrated in FIG. 7E in order to size and finish such cam shaft lobe.

Figure 7I:
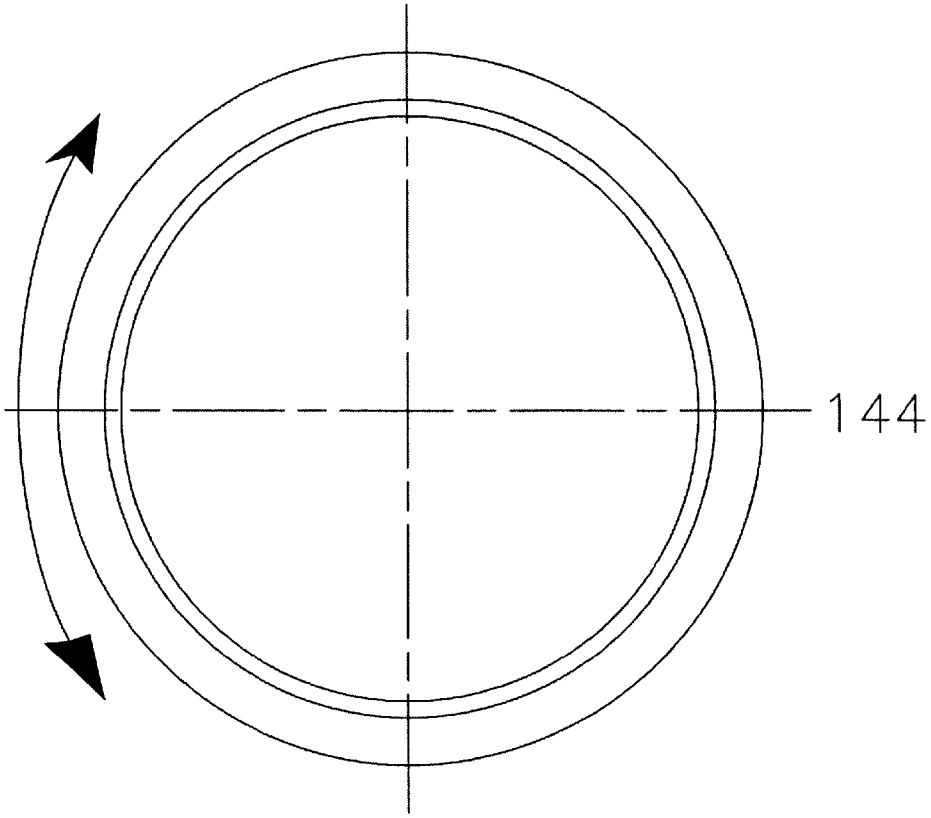
FIG. 7I is a side elevational view of the cone shaped part of FIG. 7H.
Figure 7H:
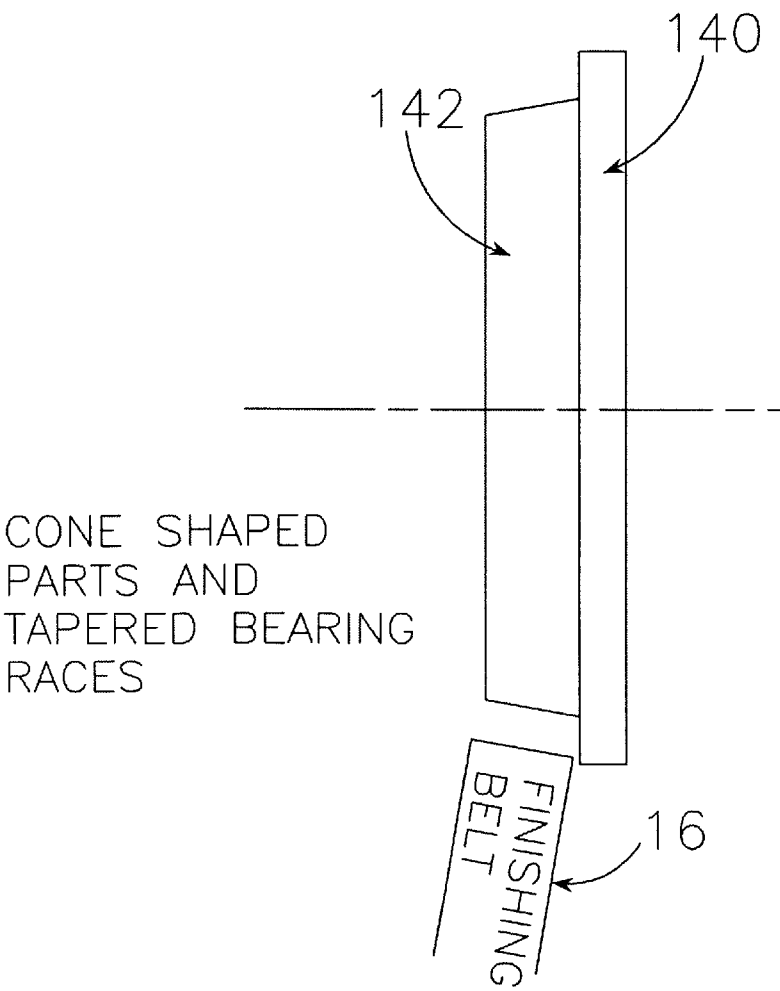
FIG. 7H is a front elevational view of a cone-shaped part or a tapered bearing race which can be finished by the precision sizing and finishing machine according to the present invention.

While in the previous embodiments discussed, the belt is always oriented normal to a longitudinal centerline of the workpiece, it should be recognized that such belt orientation is not always necessary. FIG. 7H illustrates a workpiece 140 having a cone shaped work surface 142 which is being worked by a finishing belt 16. In this embodiment, the finishing belt, while it is oriented perpendicular to the cone shaped surface 142 being worked, is at an acute angle in relationship to an axial centerline 144 of the workpiece 140 as illustrated in FIG. 7I.

With reference now to FIG. 8B, the abrasive belt and tooling slide according to the present invention need not incorporate a backup belt as is illustrated in FIG. 2. Rather, an abrasive belt 150 can be supported only on a pair of smaller diameter front rollers 152 and 154 and a larger diameter rear roller 156. However, in this embodiment a housing 158, which supports the three rollers 152, 154, 156, merely has a gap or indented section 159 between the front two rollers 152 and 154. The gap 159 is clearance for the workpiece.

As is illustrated in FIG. 8B, the rollers 152, 154 and 156 can be conventional crowned rollers on which the belt 150 can center itself once the belt is being rotated.

Figure 9:
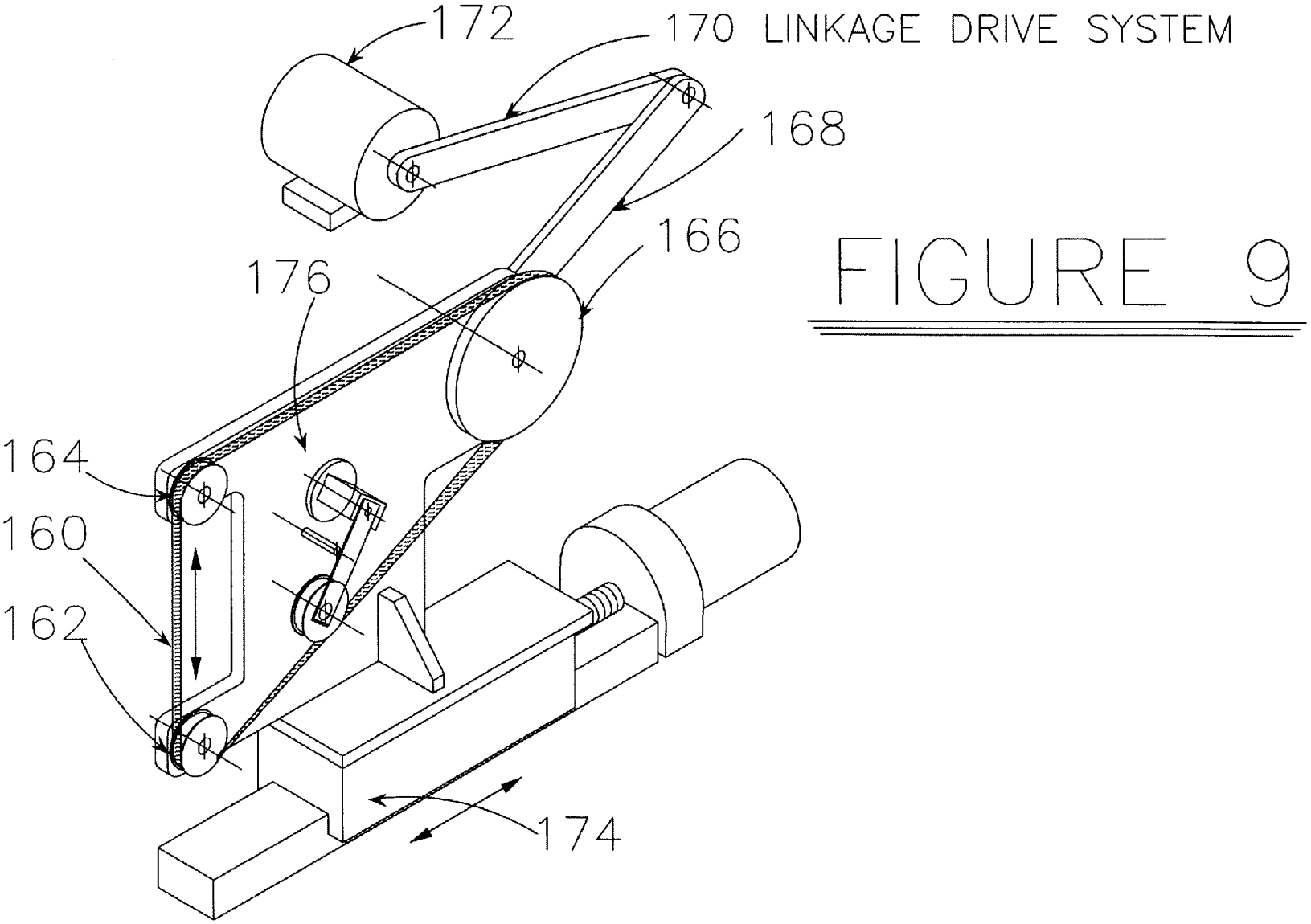
FIG. 9 is a perspective view of an abrasive belt housing and slide of a workpiece sizing and finishing apparatus according to a sixth embodiment of the present invention; and, FIG. 10 is a flow chart illustrating the method steps employed when sizing and finishing the workpiece with the apparatus according to the present invention.

Depending on the part which is being worked on by the sizing and finishing machine of the present invention, the motor may or may not be located on the tooling slide. With reference now to FIG. 9, a sizing and finishing apparatus according to this embodiment of the invention, includes an abrasive belt 160 mounted on a pair of smaller front rollers 162 and 164 and a larger rear roller 166 which is driven via a linkage system 168 and 170 by a suitable motor 172. In this embodiment, the motor 172 is not mounted on a tooling slide 174 on which a housing 176 of the abrasive belt 160 is mounted. Rather, the motor 172 is mounted in a fixed location, in relation to the tooling slide 174 and the movable linkage system 168 and 170—which can comprise a set of known V-belts (not illustrated)—connects the motor to the slide which reciprocates, as previously discussed.

Figure 10:
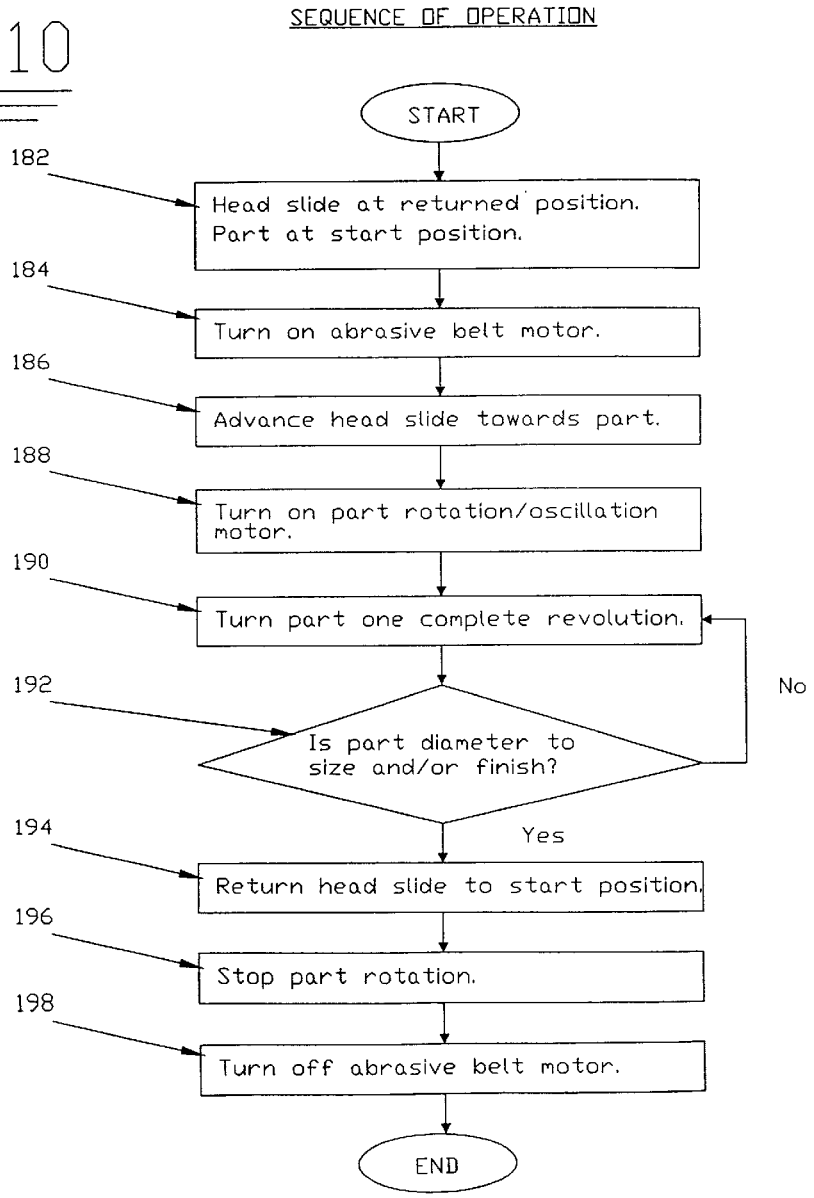

With reference now to FIG. 10, the sequence of operation of the precision, sizing and finishing machine according to the present invention is there illustrated in block diagram form. When the head slide is at the return position and the workpiece or part is at the start position, as shown in block 182, then the abrasive belt motor is started, as shown in block 184. The head slide is then advanced towards the part as illustrated in block 186. The part rotation and oscillation motor is started, as illustrated in block 188. The part is turned one complete revolution as illustrated in block 190. Readings are then taken to determine whether the part diameter is now sized and/or finished to the desired degree, as illustrated in block 192. If not, then the part is turned another complete revolution, as illustrated in block 190. If the part or workpiece is now sized and finished to the desired degree, the head slide is returned to the start position, as illustrated in block 194. The part rotation is stopped, as illustrated in block 196. The abrasive belt motor is then turned off, as illustrated in block 198.

It should be appreciated that, based on component specifications, variations to the sequence of operation illustrated in FIG. 10 could occur. Such variations can comprise when the belt motor is turned on, when the part rotation motor is turned on and when the oscillation motor is turned on, if at all. Thus, it could well be that the part rotation motor is turned on first, the abrasive belt motor is turned on next and the oscillation motor is turned on last, or not at all.

With the microfinishing machine according to the present invention, one is able to microfinish crankshaft main bearings and crankpin journal diameters, standard camshaft main bearing diameters, eccentric diameters and camlobes, transmission components and cone angles on other types of components without any physical changes to housing or abrasive belt rollers. The only change required is the abrasive belt to suit the bearing width and program changes to the belt rotation speed controller and the finishing slide position and velocity controller to suit the workpiece. In addition, the apparatus according to the present invention is capable of microfinishing two or more diameters of the same or different size eccentrics or camlobes by the addition of one or more multiple belts. Moreover, one can microfinish thrust walls on associated workpieces with additional finishing heads or microfinish fillet radii on workpieces with additional finishing heads.

The invention has been described with reference to several preferred embodiments. Obviously, modifications and alterations will occur to others upon a reading and understanding of this specification. It is intended to include all such alterations and modifications as come within the scope of the attached claims or the equivalents thereof.

What is claimed is:

1. A sizing and finishing machine comprising:

a means for rotating an associated workpiece;

a first microfinishing belt for selectively contacting the associated workpiece;

a first means for rotatably holding said first microfinishing belt;

a first housing on which said first means for rotatably holding said first microfinishing belt is mounted;

a first means for moving the first housing, and hence said first microfinishing belt, toward and away from the associated workpiece wherein said first means is timed to the rotation of the associated workpiece to maintain a substantially constant pressure of said first microfinishing belt on the associated workpiece, and, a means for allowing said microfinishing belt to conform to a shape of the associated workpiece as said microfinishing belt is moved in relation to the associated workpiece, and a means for limiting a pressure applied by said first microfinishing belt to the associated workpiece to less than 25 psi.

2. The machine of claim 1 wherein the associated workpiece is held in a workpiece housing comprising:

a headstock for holding one end of the associated workpiece;

a tailstock for holding another end of the associated workpiece; and, wherein said means for rotating the associated workpiece rotates the associated workpiece around a longitudinal axis of the associated workpiece.

3. The machine of claim 1 wherein said first microfinishing belt is an endless belt and further comprising a motor for rotating said endless belt.

4. The machine of claim 1 further comprising:

a second microfinishing belt for selectively contacting the associated workpiece, said second belt being spaced from said first belt;

a second means for rotatably holding said second microfinishing belt and a second housing on which said second means for rotatably holding said second microfinishing belt is mounted.

5. The machine of claim 4 further comprising:

a second means for moving said second housing, wherein said second means is independent of said first means so that said second housing can be moved independently of said first housing.

6. The machine of claim 1 further comprising a means for limiting a rotational speed of the associated workpiece.

7. The machine of claim 1 further comprising a means for limiting a pressure applied by said first microfinishing belt to the associated workpiece to less than approximately 25 psi.

8. The machine of claim 1 further comprising a release control for said microfinishing belt, said release control being located adjacent said means for rotatably holding said microfinishing belt.

9. The machine of claim 1 further comprising a resilient backup belt positioned behind said microfinishing belt.

10. A sizing and finishing machine comprising:

a means for rotating an associated workpiece;

an endless abrasive belt for microfinishing the associated workpiece;

a finishing slide on which said belt is mounted for rotation, wherein said rotating belt contacts the associated workpiece over an elongated contact area as the associated workpiece is rotated;

a belt rotation speed controller for controlling a rotational speed of said belt;

a slide position and velocity controller for controlling a location and velocity of movement of said slide; and, a workpiece orientation and velocity controller for determining a rotational speed of the associated workpiece and an orientation of the associated workpiece.

11. The machine of claim 10 further comprising a housing on which the associated workpiece is held, said housing comprising:

a headstock for holding a first end of the associated workpiece;

a tailstock for holding a second end of the associated workpiece; and, wherein said means for rotating the associated workpiece comprises a motor.

12. The machine of claim 10 further comprising:

a plurality of rollers, mounted on said finishing slide, around which said belt is looped;

a motor for driving at least one of said rollers; and, a belt release mechanism for releasing said belt from said plurality of rollers.

13. The machine of claim 10 further comprising a back up element which stiffens said endless belt.

14. The machine of claim 13 wherein said back up element comprises a second endless belt.

15. The machine of claim 10 further comprising a means for moving said finishing slide toward and away from the associated workpiece.

16. A method for sizing or finishing an associated workpiece comprising:

mounting a workpiece on a first housing for rotation around a longitudinal axis of the workpiece;

mounting an abrasive belt on a second housing spaced from the workpiece;

rotating the workpiece around its longitudinal axis;

advancing the abrasive belt mounted on the second housing during said step of rotating the workpiece;

forming a line contact between the abrasive belt and the rotating workpiece during said step of advancing the abrasive belt; and, moving the second housing toward and away from the workpiece so as to maintain a substantially constant pressure of the advancing abrasive belt on the workpiece as the workpiece rotates and limiting the force exerted by the abrasive belt on the workpiece to a pressure less than approximately 25 psi.

17. The method of claim 16 wherein the abrasive belt is an endless belt and further comprising the step of controlling the rotational speed of the endless belt.

18. The method of claim 16 further comprising the step of controlling a rotational speed of the workpiece.

19. The method of claim 16 further comprising the step of controlling an orientation of the abrasive belt in relation to the workpiece.

20. The method of claim 16 further comprising the step of controlling the velocity of movement of the second housing in relation to the workpiece.

21. A sizing and finishing machine comprising:

a means for rotating an associated workpiece;

a moving finishing belt which selectively contacts the associated workpiece;

a plurality of rollers on which said finishing belt is rotatably mounted, said plurality of rollers comprising a first roller and, spaced therefrom, a second roller;

a housing on which said plurality of rollers are rotatably mounted, said housing comprising a first flange on which said first roller is mounted, a second flange on which said second roller is mounted and an opening defined in said housing between said flanges, wherein said finishing belt traverses said opening when moving between said first and second rollers wherein said first and second flanges are rigidly mounted on said housing; and a means for moving said housing, and hence said finishing belt, toward and away from the associated workpiece, wherein a line contact is formed between said finishing belt and the associated workpiece as said finishing belt is pushed into said opening by the associated workpiece.

22. The machine of claim 21 wherein said means for moving said housing is timed to the rotation of the associated work piece to maintain a substantially constant pressure of said finishing belt on the associated work piece.

23. The machine of claim 21 further comprising a belt release mechanism for releasing said finishing belt from said plurality of rollers.

24. The machine of claim 21 wherein said finishing belt comprises an endless belt and further comprising a third roller spaced from said first and second rollers and rotatably mounted on said housing, wherein said finishing belt is looped around said first, second and third rollers.

25. The machine of claim 24 further comprising a motor for driving at least one of said plurality of rollers.

26. A sizing and finishing machine comprising:

a means for rotating an associated workpiece;

a first microfinishing belt for selectively contacting the associated workpiece at a first location;

a first finishing slide including a first roller on which said first belt is mounted;

a second microfinishing belt for selectively contacting the associated workpiece at a second location spaced from the first location;

a second finishing slide including a second roller on which said second belt is mounted, wherein said second finishing slide is spaced from said first finishing slide;

a first motor for driving said first roller of said first finishing slide;

a second motor for driving said second roller of said second finishing slide;

a third motor for reciprocating said first finishing slide toward and away from the associated workpiece;

a fourth motor for reciprocating said second finishing slide toward and away from the associated workpiece, wherein said first and second finishing slides reciprocate independently in relation to a rotation of the associated workpiece and wherein said first and second microfinishing belts are driven independently; and, a speed controller for said first motor and for said second motor so that said first and second microfinishing belts can be driven at different speeds.

27. The sizing and finishing machine of claim 26 further comprising a means for cleansing material from an area of contact between said first and second microfinishing belts and the associated workpiece.

28. The machine of claim 26 further comprising a means for limiting a pressure applied by said first microfinishing belt to the associated workpiece to a pressure less than approximately 25 psi.

29. A method for sizing or finishing a workpiece comprising the steps of:

rotating a workpiece around a longitudinal axis thereof;

mounting an abrasive belt on a housing spaced from the workpiece;

advancing the abrasive belt toward the workpiece during said step of rotating the workpiece;

contacting the rotating workpiece with the abrasive belt;

moving the abrasive belt past the workpiece; and, forming an elongated contact area between the abrasive belt and the workpiece due to contact with the workpiece.

30. The method of claim 29 further comprising the step of oscillating the workpiece during said step of contacting the rotating workpiece with the abrasive belt.

31. The method of claim 29 further comprising the step of mounting a second abrasive belt on a second housing spaced from the workpiece, wherein the second housing is spaced from the first housing.

32. The method of claim 31 further comprising the step of independently driving the first and second belts.

33. The method of claim 32 further comprising the step of independently controlling a rotational speed of each of the first and second abrasive belts.

34. The method of claim 29 further comprising the step of providing a backup belt to resiliently bias the abrasive belt toward the workpiece as it contacts the workpiece.

* * * * *